US008165489B2

(12) United States Patent
Mikuni

(10) Patent No.: US 8,165,489 B2
(45) Date of Patent: Apr. 24, 2012

(54) IMAGE FORMING APPARATUS HAVING COOLING FANS

(75) Inventor: Atsushi Mikuni, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 533 days.

(21) Appl. No.: 12/389,794

(22) Filed: Feb. 20, 2009

(65) Prior Publication Data

US 2009/0214250 A1 Aug. 27, 2009

(30) Foreign Application Priority Data

Feb. 22, 2008 (JP) ..... 2008-041367

(51) Int. Cl.
*G03G 15/20* (2006.01)
*G03G 15/00* (2006.01)

(52) U.S. Cl. ..... 399/92; 399/18; 399/33

(58) Field of Classification Search ..... 399/33, 399/91–93, 98, 18
See application file for complete search history.

(56) References Cited

U.S. PATENT DOCUMENTS

| | | | |
|---|---|---|---|
| 6,985,677 | B2 | 1/2006 | Yamagata et al. |
| 7,403,741 | B2 | 7/2008 | Yoshihara et al. |
| 2004/0096229 | A1 | 5/2004 | Yoshihara et al. |
| 2008/0013981 | A1 | 1/2008 | Kimura et al. |

FOREIGN PATENT DOCUMENTS

| | | | |
|---|---|---|---|
| JP | 6-301260 | A | 10/1994 |
| JP | 10-228226 | A | 8/1998 |
| JP | 10-228266 | A | 8/1998 |
| JP | 2002-229417 | A | 8/2002 |
| JP | 2002-277036 | A | 9/2002 |
| JP | 2004-093708 | A | 3/2004 |
| JP | 2004-163628 | A | 6/2004 |
| JP | 2004-309526 | A | 11/2004 |
| JP | 2004-309796 | A | 11/2004 |
| JP | 2006-227558 | A | 8/2006 |
| JP | 2007-041321 | A | 2/2007 |
| JP | 2007-206652 | A | 8/2007 |
| JP | 2007-240844 | A | 9/2007 |
| JP | 2008-014986 | A | 1/2008 |

OTHER PUBLICATIONS

JP Office Action dtd Apr. 27, 2010, JP Appln. 2008-041367, English translation.

JP Office Action dtd Jul. 27, 2010, JP Appln. 2008-041367, partial English translation.

*Primary Examiner* — Hoang Ngo
(74) *Attorney, Agent, or Firm* — Banner & Witcoff, Ltd.

(57) ABSTRACT

An image forming apparatus includes a first fan and a second fan that are configured to generate air in a main body of the apparatus, a controller configured to control operations of the fans, and a detector configured to detect a malfunction of a first fan. When the detector detects the malfunction of the first fan, the controller increases a voltage applied to the second fan as compared with that before the malfunction is detected.

13 Claims, 5 Drawing Sheets

IMAGE FORMING APPARATUS HAVING COOLING FANS

CROSS REFERENCE TO RELATED APPLICATION

This application claims priority from Japanese Patent Application No. 2008-041367, filed on Feb. 22, 2008, the entire subject matter of which is incorporated herein by reference.

FIELD

Aspects of the invention relate to an image forming apparatus, and more specifically to an electrophotographic image forming apparatus.

BACKGROUND

A known image forming apparatus may be provided with two blowers to prevent the apparatus's temperature from excessively rising.

The two blowers can prevent the temperature in the apparatus from excessively rising while they operate properly. However, when a malfunction occurs in one of the blowers and the blower in question stops or a quantity of air generated by the blower in question decreases an excessive rise in temperature of the image forming apparatus cannot be sufficiently prevented.

SUMMARY

Illustrative aspects of the invention provide an image forming apparatus having a plurality of blowers, which is configured to prevent an excessive rise in temperature of the image forming apparatus even if one of the blowers malfunctions.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. An image forming apparatus according to aspects of the invention applies to an electrophotographic image forming apparatus 1 as shown in FIG. 1.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used. In FIG. 1, the left side is referred to as the rear or the rear side, the right side is referred to as the front or front side, the up side is referred to as the top or upper side, and the down side is referred to as the bottom or lower side. In FIGS. 1-4, all components are not shown for purposes of brevity.

Figure 1:
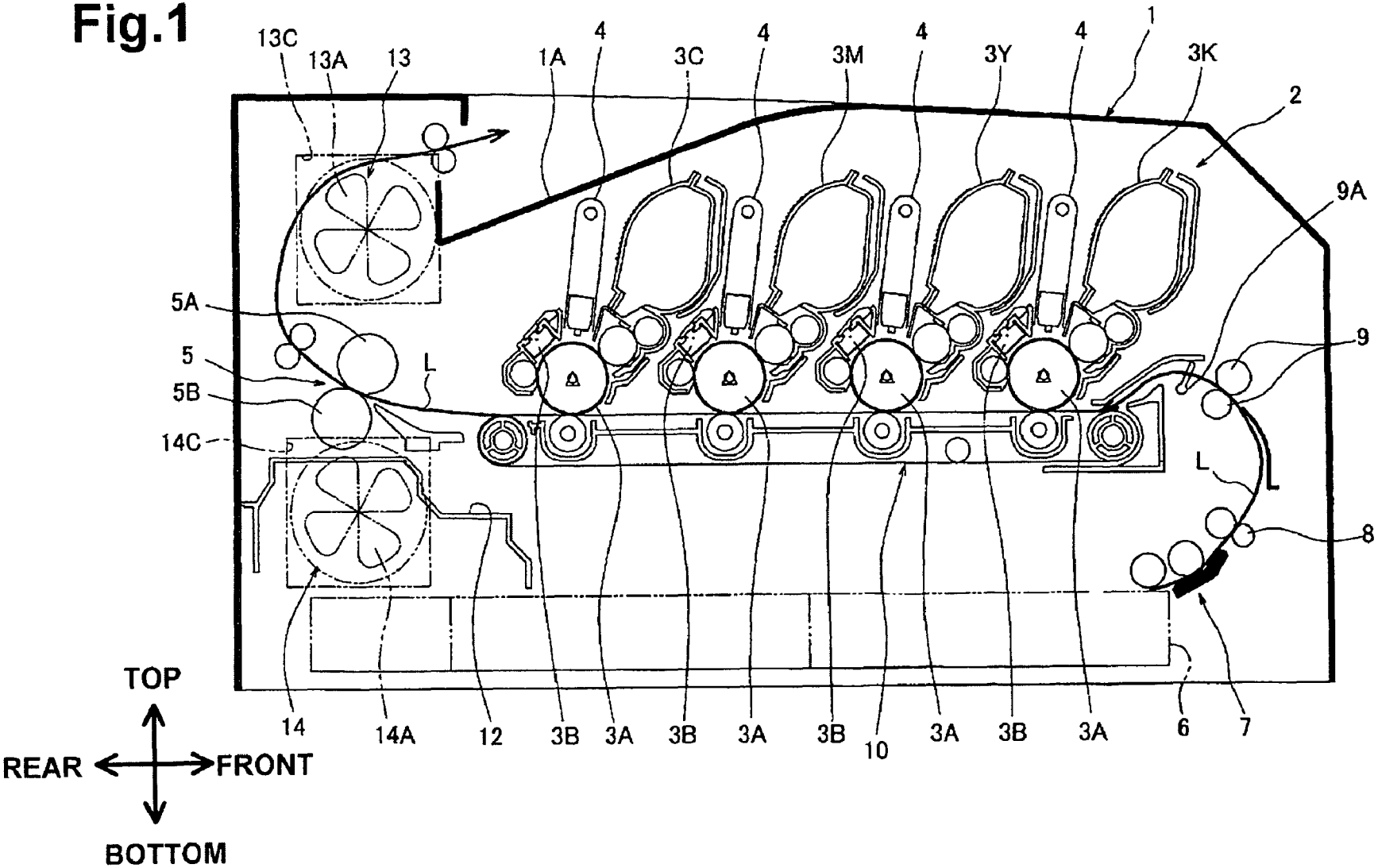
FIG. 1 is a side sectional view of an internal structure of an illustrative example of an image forming apparatus using features described herein.

As shown in FIG. 1, the image forming apparatus 1 may include an image forming unit 2 that is configured to form an image on a recording medium, such as a recording sheet (e.g., plain paper, transparency, etc). The image forming unit 2 may include four process cartridges 3K, 3Y, 3M, 3C, a light exposing unit 4, and a fixing unit 5.

The image forming unit 2 employs a direct tandem system in which four color developer images formed by the process cartridges 3K, 3Y, 3M, 3C storing developers (toners) of black (K), yellow (Y), magenta (M), and cyan (C) respectively, are overlapped with one another on a recording sheet to form a color image.

An uppermost recording sheet is separated and picked up from the stack of recording sheets in the sheet supply tray 6 by the sheet supply mechanism 7, dust is removed from the recording sheet by a dust removing roller 8, and the recording sheet is fed between a pair of registration rollers 9 to correct skew of the recording sheet, and then to a belt unit 10.

The process cartridges 3K, 3Y, 3M, 3C are arranged in tandem in this order from the front of the image forming apparatus 1 so as to face a conveyance surface of the belt unit 10 on which the recording sheet is conveyed or fed. In other words, the process cartridges 3K, 3Y, 3M, 3C are arranged above the conveyance surface of the belt unit 10 in this order from an upstream side along a direction where the recording sheet is fed (hereinafter referred to as a sheet feeding direction). In this illustrative embodiment, developer images of black, yellow, magenta, and cyan are sequentially transferred onto the recording sheet being fed on the belt unit 10, and fixed by the fixing unit 5 to the recording sheet.

The recording sheet on which an image has been formed is fed from the fixing unit 5 in an upward direction, and ejected onto an output tray 1A disposed on a top surface of the image forming apparatus 1.

Each process cartridge 3K, 3Y, 3M, 3C includes a photosensitive drum 3A and a charger 3B. Each photosensitive drum 3A is configured to carry a developer image thereon, and each charger 3B is configured to charge the corresponding photosensitive drum 3A. When the photosensitive drum 3A is charged by the charger 3B, and exposed to light by the light exposing unit 4, an electrostatic latent image is carried or formed on a surface of the photosensitive drum 3A. The electrostatic latent image carried on the photosensitive drum 3A is supplied with a developer, and a developer image is carried on the surface of the photosensitive drum 3A.

The fixing unit 5 may include a heat roller 5A having a heat source such as a halogen lamp and a pressure roller 5B disposed facing the heat roller 5A so as to press the heat roller 5A. The fixing unit 5 is configured to fix developer images onto a recording sheet by heat while the recording sheet is fed between the heat roller 5A and the pressure roller 5B.

A post-registration sensor 9A is disposed downstream from the registration rollers 9 in the sheet feeding direction and upstream of the belt unit 10. The post-registration sensor 9A is configured to detect whether a recording sheet has passed the registration rollers 9 and entered the belt unit 10.

Figure 2:
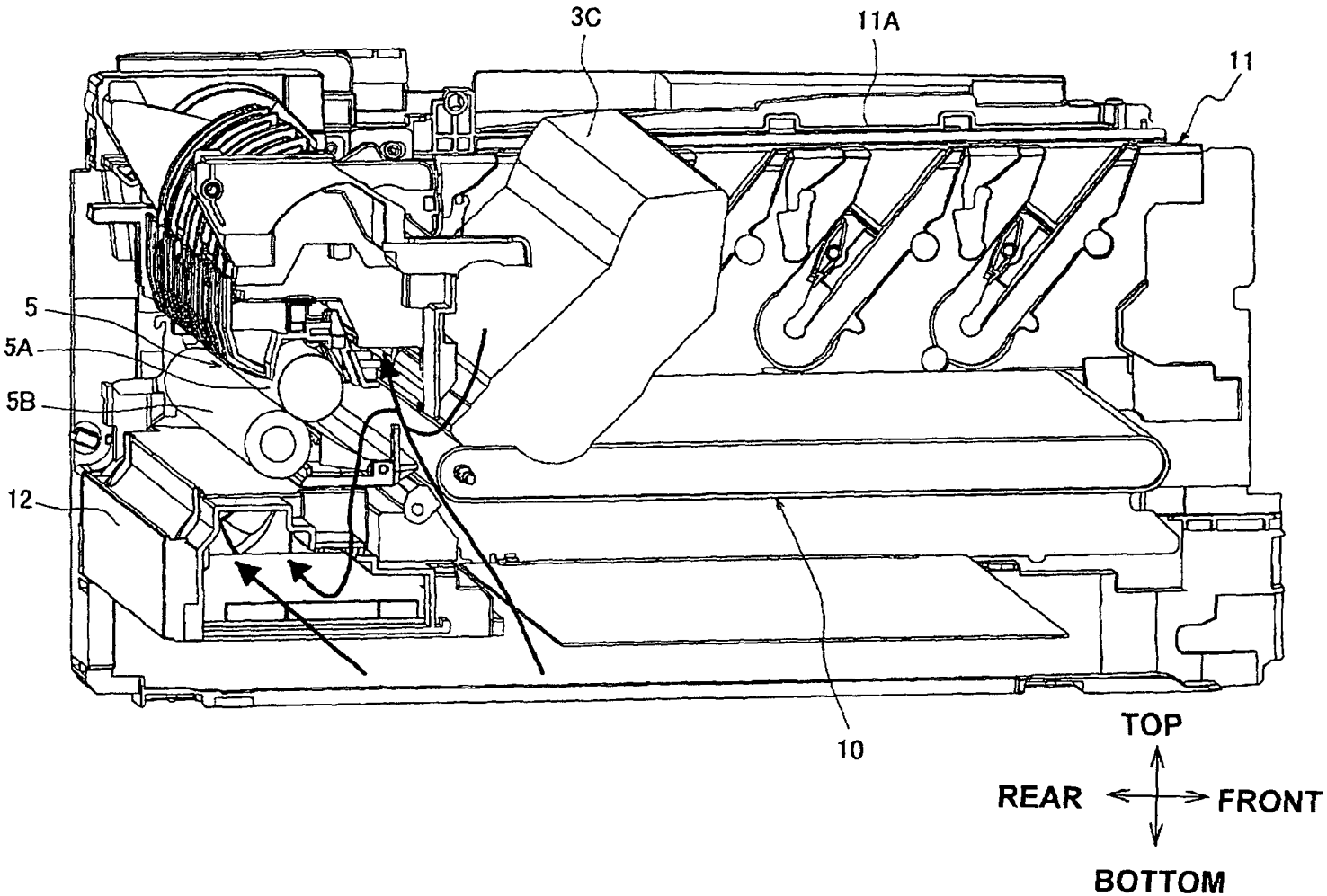
FIG. 2 is a perspective view mainly showing a fixing unit and a low voltage power supply of the image forming apparatus according to illustrative aspects.

The four process cartridges 3K, 3Y, 3M, 3C are detachably attached to a body frame 11 (FIG. 2) which is part of a main body of the image forming apparatus 1. As shown in FIG. 2, the body frame 11 includes a side frame 11A on each side of the image forming apparatus 1 in a widthwise direction thereof, and a connection frame (not shown) that connects the side frame 11A on each side.

A low voltage power supply 12 is disposed under the pressure roller 5B on an opposite side of the heat roller 5A from a sheet feed path L shown in FIG. 1. The low-voltage power supply 12 is configured to supply electric components of the image forming apparatus 1 with electric power that is supplied from a household power supply.

Figure 3:
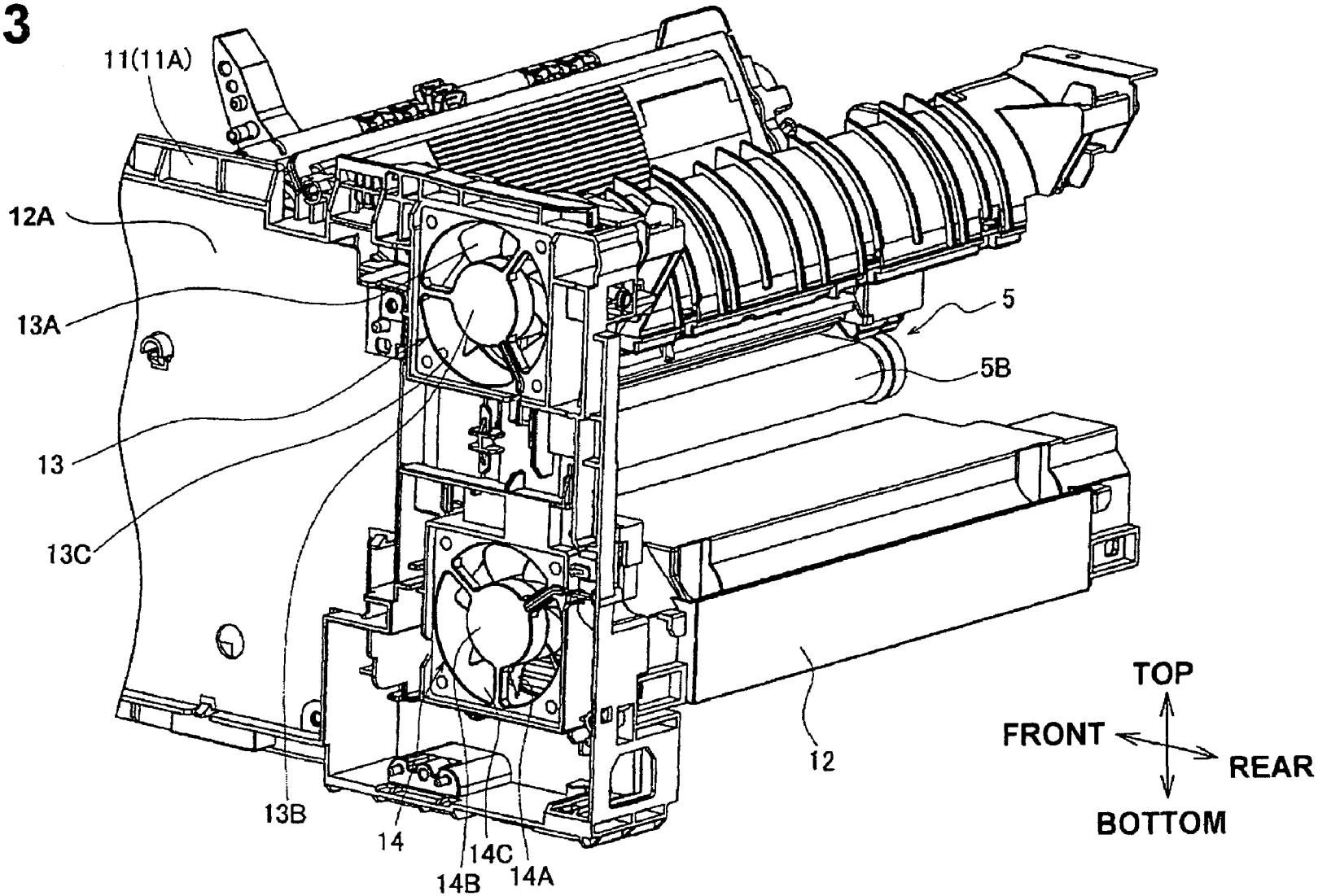
FIG. 3 is a perspective view when components shown in FIG. 2 are shown from the rear according to illustrative aspects.

As shown in FIG. 3, a high voltage power supply 12A is disposed on the side frame 11A and is configured to supply high voltage to the chargers 3B. The high voltage power supply 12A is configured to boost voltage supplied from the low voltage power supply 12 and supply the boosted voltage to the chargers 3B.

As shown in FIG. 1, the image forming apparatus 1 may further include a first blower 13 and a second blower 14. The first blower 13 and the second blower 14 are disposed at a side of the image forming apparatus 1 in a widthwise direction thereof, e.g. on the same side as the side frame 11A in this embodiment as shown in FIG. 3. The first blower 13 is configured to generate airflow in the vicinity of the fixing unit 5 by suction and the second blower 14 is configured to generate airflow in the vicinity of the low voltage power supply 12 by suction.

As shown in FIG. 3, the first blower 13 is disposed on the same side as the side frame 11A of the image forming apparatus 1 and located higher than the fixing unit 5, in order to exhaust air generated around the fixing unit 5 through exhaust holes 13C. The second blower 14 is disposed under the first blower 13 on the same side of the side frame 11A of the image forming apparatus 1 and located at a position corresponding to the low-voltage power supply 12, in order to exhaust air generated around the low-voltage power supply 12 through exhaust holes 14C.

The first blower 13 includes an axial fan 13A for generating airflow in an axial direction and an electric first fan motor 13B for rotating the axial fan 13A. The second blower 14 includes an axial fan 14A for generating airflow in an axial direction and an electric second fan motor 14B for rotating the axial fan 14A.

Figure 4:
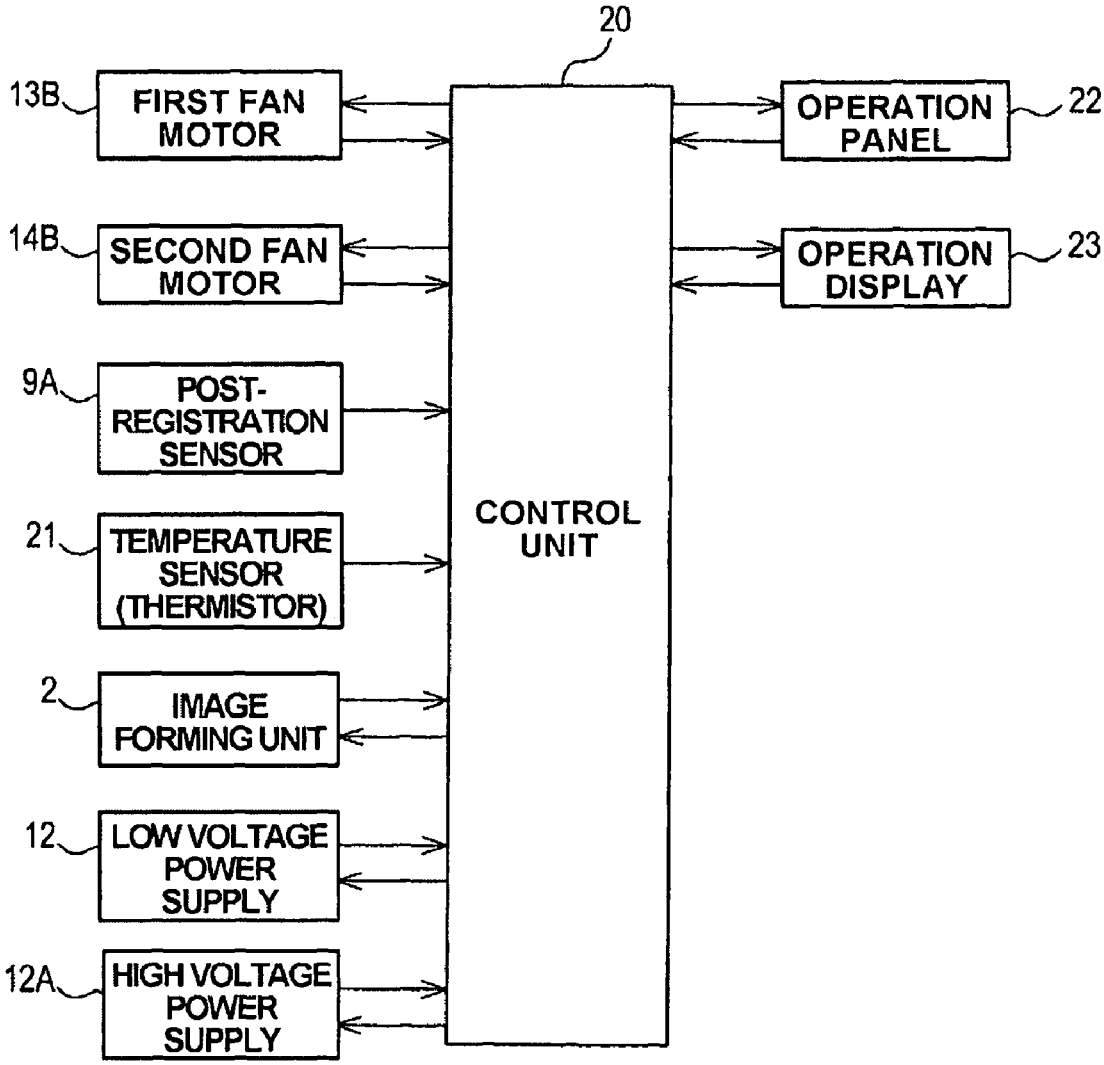
FIG. 4 is an electrical block diagram of the image forming apparatus according to illustrative aspects.

As shown in FIG. 4, a control unit 20 controls operations of electric components, including the first and second fan motors 13B, 14B and the image forming unit 2. Each of the first and second fan motors 13B, 14B inputs a signal indicating its actual rotation speed to the control unit 20. The control unit 20 changes a voltage applied to the fan motors 13B, 14B to change the rotation speeds of the fan motors 13B, 14B. When the rotation speeds of the fan motors 13B, 14B are changed, the quantity of air generated by the fan motor 13B, 14B is changed. The control unit 20 causes the fan motors 13B, 14B to supply a required quantity of air through the application of a voltage of, for example, 10V during standby, 16V during printing, and 24V under abnormal conditions.

Thus, when issuing an operation command to the first and second fan motors 13B, 14B for the first and second blowers 13, 14, the control unit 20 can detect whether the first and second fan motors 13B, 14B rotate.

The control unit 20 is connected to a temperature sensor or thermistor 21, an operation panel 22, and a display panel 23. The temperature sensor 21 is configured to detect the ambient temperature in the main body of the image forming apparatus 1. The control unit 20 receives a detection signal from the temperature sensor 21. The operation panel 22 is configured to receive an instruction from a user and the display panel 23 is configured to display information.

The control unit 20 may be, for example, a controller including a known microcomputer including a central processing unit (CPU), read-only memory (ROM), a random access memory (RAM) and other memories. The control unit 20 controls the electronic components connected thereto such as the first and second fan motors 13B, 14B and the image forming unit 2 based on programs stored in the ROM.

Figure 5:
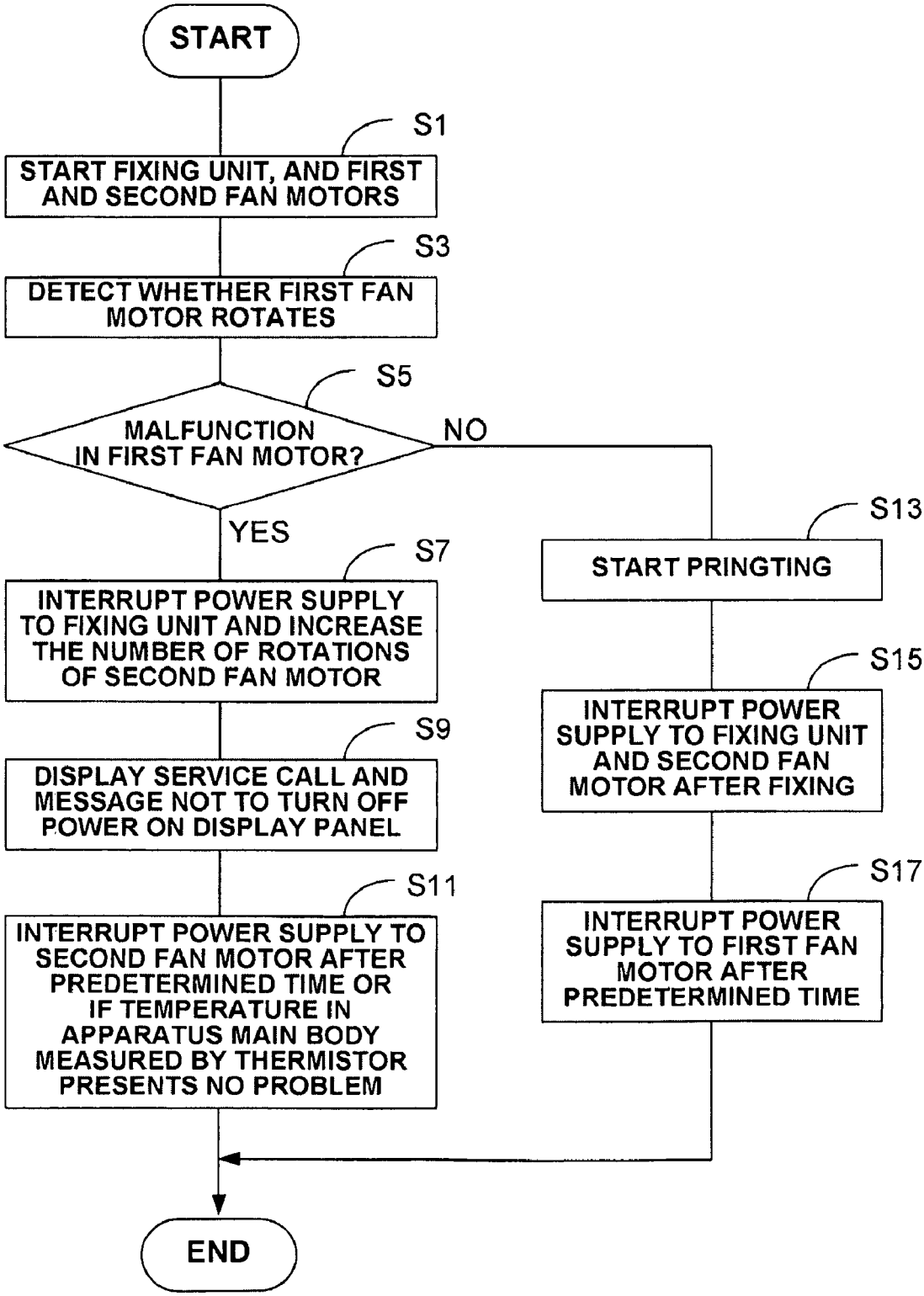
FIG. 5 is a flowchart showing an operation of the image forming apparatus according to illustrative aspects.

With reference to FIG. 5, a control process of the first and second fan motors 13B, 14B of the image forming apparatus 1 is described. The control process is started up and carried out by the control unit 20 when a print command is issued to the image forming apparatus 1 or the image forming apparatus 1 receives print data.

When the image forming apparatus 1 receives print data, the control process is started up. The fixing unit 5, the first blower 13, and the second blower 14 are started at step S1. The control unit 20 functions as a detector detecting whether the first blower 13 operates or the first fan motor 13B rotates at S3 and determines whether a malfunction occurs in the first blower 13 (or the first fan motor 13B) at S5.

The control unit 20 determines that the first fan motor 13B malfunctions when the rotation speed of the first fan motor 13B, indicated by a signal that the first fan motor 13*b* inputs to the control unit 20, is different from, e.g. lower than, the rotation speed corresponding to a voltage that the control unit 20 applies to the first fan motor 13B. When the control unit 20 determines that the first blower 13 malfunctions (S5: YES), it interrupts power supply to the fixing unit 5 to stop the fixing unit 5 from generating heat. In addition, the control unit 20 increases the rotation speed of the second fan motor 14B for the second blower 14 to a speed greater than the speed of the second fan motor 14B before the malfunction of the first blower 13 is detected in S7. Thus, the quantity of air generated by the second blower 14 is increased to a greater amount than before the malfunction of the first blower 13. Specifically, the control unit 20 increases a voltage applied to the second fan motor 14B to a voltage greater than the voltage before the malfunction of the first blower 13 is detected.

A service call indicating that the first blower 13 malfunctions and a message stating that the image forming apparatus 1 should not be turned off are displayed on the display panel 23 (S9). When a predetermined period of time, e.g. 30 seconds in this illustrative embodiment, has elapsed or a detection value from the temperature sensor 21 indicates that the temperature in the main body of the image forming apparatus 1 does not reach a specified temperature, e.g. 40 degrees in this illustrative embodiment, power supply to the second blower 14 (second fan motor 14B) is interrupted (S11) and the process is finished.

When the first fan motor 13B rotates at S5 and it is not determined that the first blower 13 malfunctions (S5: No), printing for the received data is started (S13). At the completion of printing, power supply to the fixing unit 5 is interrupted or reduced, and power supply to the second blower 14 (second fan motor 14B) is interrupted (S15).

In this illustrative embodiment, it is assumed that printing of received data is completed when a recording sheet on which the received data has been printed passes the fixing unit 5, in short, when a predetermined time, e.g. 2 seconds, elapses after the trailing end of the recording sheet on which received data is to be printed passes the post-registration sensor 9A.

When a predetermined time, e.g. 30 seconds in this illustrative embodiment, elapses after power supply to the fixing unit 5 and the second blower 14 (second fan motor 14B) is interrupted, power supply to the first blower 13 (first fan motor 13B) is interrupted (S17), and the process is finished.

In this illustrative embodiment, when a malfunction is detected in the first blower 13, the quantity of air generated by the second blower 14 is increased to an amount greater than the amount before the malfunction of the first blower 13 is detected. Thus, even if the first blower 13 malfunctions, the temperature in the main body of the image forming apparatus 1 can be prevented from rising excessively.

In the electrophotographic image forming apparatus, a developer transferred onto a recording sheet is fixed by heat, and thus a large amount of heat is generated in the fixing unit 5 (or the heat roller 5A).

In this illustrative embodiment, in the event of a malfunction of the first blower 13 that generates airflow around the fixing unit 5, the quantity of air generated by the second blower 14 is increased to an amount greater than the amount before the malfunction is detected. Thus, even when the first blower 13 malfunctions, an excessive rise in the temperature in the main body of the image forming apparatus 1 can be effectively prevented.

When the first and second blowers 13, 14 operate together, in other words, when image formation or printing is normally performed, the airflow around the fixing unit 5 and the airflow around the low-voltage power supply 12 travels as shown by arrows in FIG. 2.

When the image formation or printing is completed, power supply to the fixing unit 5 is interrupted or reduced, and the current flowing in the low-voltage power supply 12 accordingly becomes small. Thus, at the completion of the image formation, power supply to the first and second blowers 13, 14 may be interrupted.

However, the fixing unit 5 has a heating value higher than the low-voltage power supply 12, and the temperature around the fixing unit 5 is kept high even if power supply to the fixing unit 5 is interrupted or reduced. Thus, if power supply to the first blower 13 is interrupted at the completion of the image formation, a malfunction may occur in the components, e.g. the process cartridge 3C, adjacent to the fixing heat 5 due to heat remaining in the fixing unit 5.

In this connection, when the temperature of the process cartridge 3C excessively rises, the developer stored in the process cartridge 3C may melt and then solidify.

On the other hand, in this illustrative embodiment, when the image formation is completed, the second blower 14 only is stopped and the first blower 13 is continuously operated. Thus, air flows around the low-voltage power supply 12 while the second blower 14 operates and moves toward the fixing unit 5, so that the quantity of air flowing around the fixing unit 5 is increased as compared with the quantity of air flowing when the second blower 14 is operated.

The air around the fixing unit 5 whose quantity has been increased functions as an air curtain, which can prevent heat generated in the fixing unit 5 from moving toward the process cartridge 3C and prevent malfunction from occurring in components adjacent to the fixing unit 5 due to heat remaining in the fixing unit 5.

The above illustrative embodiment shows that, but is not limited to, the quantity of air is increased by increasing the rotation speed of fan motor that is a drive source. For example, to increase the amount of airflow, an axial fan having longer blades or a great blade angle may be used.

The above illustrative embodiment shows, but is not limited to, the axial fans for the first and second blowers 13, 14. Instead, other types of fans including, but not limited to, a centrifugal fan and cross-flow fan may be used.

The above illustrative embodiment shows that, but is not limited to, the malfunction in the first blower 13 only is detected. However, a malfunction in either one of the first and second blowers 13, 14 may be detected. If a malfunction in one blower is detected, the quantity of air generated by the other blower in which the malfunction does not occur may be increased to an amount greater than the amount before the malfunction is detected.

The above illustrative embodiment shows that, but is not limited to, the low-voltage power supply 12 is disposed under the fixing unit 5.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a recording sheet, comprising:

a main body;

a fixing unit including a heating element, the fixing unit configured to generate heat and fix a developer image transferred onto the recording sheet thereto;

a first fan disposed higher than the fixing unit as viewed in an axial direction of the heating element, the first fan configured to generate air in the main body around the fixing device;

a second fan disposed under the heating element as viewed in the axial direction and configured to generate air in the main body;

a controller configured to control operation of the first fan and the second fan; and a detector configured to detect whether a malfunction of the first fan occurs, wherein when the detector detects the malfunction of the first fan, the controller increases a voltage applied to the second fan as compared with the voltage applied before the malfunction was detected.

2. The image forming apparatus according to claim 1, further comprising a power supply unit configured to supply current to electronic components in the main body of the image forming apparatus, wherein the second fan is configured to generate air around the power supply unit.

3. The image forming apparatus according to claim 2, wherein the power supply unit is disposed on a side of a path where the recording sheet is fed opposite a side of the path where the heating element is disposed.

4. The image forming apparatus according to claim 2, wherein the power supply unit and the second fan overlap each other as viewed in the axial direction.

5. The image forming apparatus according to claim 2, further comprising a sheet supply tray configured to receive a stack of recording sheets and disposed under the power supply unit as viewed in the axial direction.

6. The image forming apparatus according to claim 1, wherein when the detector detects the malfunction of the first fan, the controller stops heat generation of the fixing device.

7. An image forming apparatus configured to form an image on a recording sheet, comprising:

a main body;

a fixing unit including a heating element, the fixing unit configured to generate heat and fix a developer image transferred onto the recording sheet thereto;

a first fan disposed higher than the fixing unit as viewed in an axial direction of the heating element, the first fan configured to generate air in the main body around the fixing device;

a second fan disposed under the heating element as viewed in the axial direction and configured to generate air in the main body;

a controller configured to control the first fan in a first rotation speed and the second fan in a second rotation speed; and a detector configured to detect a rotation speed of the first fan, wherein when the controller detects that the rotation speed of the first fan detected by the detector is lower than the first rotation speed, the controller increases a rotation speed of the second fan to a rotation speed greater than the second rotation speed.

8. The image forming apparatus according to claim 7, further comprising a power supply unit configured to supply current to electronic components in the main body of the image forming apparatus, wherein the second fan is configured to generate air around the power supply unit.

9. The image forming apparatus according to claim 8, wherein the power supply unit is disposed on a side of a path where the recording sheet is fed opposite a side of a path where the heating element is disposed.

10. The image forming apparatus according to claim 8, wherein the power supply unit and the second fan overlap each other as viewed in the axial direction.

11. The image forming apparatus according to claim 8, further comprising a sheet supply tray configured to receive a stack of recording sheets and disposed under the power supply unit as viewed in the axial direction.

12. The image forming apparatus according to claim 8, wherein when the detector detects the malfunction of the first fan, the controller stops heat generation of the fixing device.

13. An image forming apparatus configured to form an image on a recording sheet, comprising:

a main body;

a fixing unit including a heating element, the fixing unit configured to generate heat and fix a developer image transferred onto the recording sheet thereto;

a first fan disposed higher than the fixing unit as viewed in an axial direction of the heating element, the first fan configured to generate air in the main body around the fixing device;

a second fan disposed under the heating element as viewed in the axial direction and configured to generate air in the main body;

a controller configured to control operation of the first fan and the second fan; and a detector configured to detect whether a malfunction of the second fan occurs, wherein when the detector detects the malfunction of the second fan, the controller increases a voltage applied to the first fan as compared with the voltage applied before the malfunction was detected.

* * * * *